US006547291B1

(12) United States Patent
Schwaiger

(10) Patent No.: US 6,547,291 B1
(45) Date of Patent: Apr. 15, 2003

(54) LATCH ASSEMBLY FOR VEHICLE HOOD

(75) Inventor: Dennis D. Schwaiger, Whitmore Lake, MI (US)

(73) Assignee: Midway Products Group, Inc., Whitmore Lake, MI (US)

( * ) Notice: Subject to any disclaimer, the term of this patent is extended or adjusted under 35 U.S.C. 154(b) by 3 days.

(21) Appl. No.: 09/771,414

(22) Filed: Jan. 26, 2001

(51) Int. Cl.[7] ..... E05C 3/06

(52) U.S. Cl. ..... 292/216; 292/109; 292/110; 292/111; 292/DIG. 14

(58) Field of Search ..... 292/216, 26, 28, 292/50, 109, 11, 111, DIG. 14, 110, 578; 74/104

(56) References Cited

U.S. PATENT DOCUMENTS

| | | | | | |
|---|---|---|---|---|---|
| 2,246,787 | A | | 6/1941 | Dall | |
| 2,246,794 | A | | 6/1941 | Dall | |
| 2,256,465 | A | | 9/1941 | Brubaker | |
| 3,796,075 | A | | 3/1974 | Grogan | |
| 3,905,624 | A | | 9/1975 | Fujita | |
| 4,045,064 | A | * | 8/1977 | Okada | 292/125 |
| 4,237,709 | A | * | 12/1980 | Krugener et al. | 292/5 |
| 4,441,345 | A | * | 4/1984 | Guarr | 292/209 |
| 4,456,289 | A | | 6/1984 | Badiali | |
| 4,542,913 | A | * | 9/1985 | Giesmann | 172/272 |
| 4,671,548 | A | | 6/1987 | Häberle et al. | |
| 4,702,094 | A | | 10/1987 | Peterson | |
| 4,752,092 | A | | 6/1988 | Faust | |
| 4,756,562 | A | * | 7/1988 | Foster et al. | 292/28 |
| 4,836,591 | A | | 6/1989 | Faust | |
| 4,875,350 | A | | 10/1989 | Faust | |
| 4,875,724 | A | * | 10/1989 | Gruber | 292/216 |
| 4,936,611 | A | * | 6/1990 | Palvolgyi | 292/216 |
| 4,951,979 | A | | 8/1990 | Escaravage | |
| 4,961,601 | A | | 10/1990 | Lindholm et al. | |
| 4,991,884 | A | * | 2/1991 | Cairns | 292/28 |
| 5,048,877 | A | | 9/1991 | Rogers, Jr. et al. | |
| 5,247,817 | A | | 9/1993 | Körner et al. | |
| 5,314,218 | A | * | 5/1994 | Nadherny | 292/11 |
| 5,327,797 | A | * | 7/1994 | Seifrit, Jr. | 74/512 |
| 5,348,355 | A | * | 9/1994 | Oyha | 292/11 |
| 5,431,460 | A | * | 7/1995 | Hass et al. | 292/216 |
| 5,445,421 | A | * | 8/1995 | Ferrara | 292/216 |
| 5,535,608 | A | * | 7/1996 | Brin | 292/DIG. 14 |
| 5,613,814 | A | * | 3/1997 | Jackson | 410/69 |
| 5,725,260 | A | | 3/1998 | Eikmeier et al. | |
| 5,738,393 | A | * | 4/1998 | Chao | 292/216 |
| 5,793,122 | A | | 8/1998 | Dingwall et al. | |
| 5,833,024 | A | | 11/1998 | Kancko | |
| 5,853,060 | A | * | 12/1998 | Chao et al. | 180/289 |
| 6,014,876 | A | * | 1/2000 | Taylor | 292/346 |
| 6,092,845 | A | * | 7/2000 | Koenig | 292/225 |
| 6,105,459 | A | * | 8/2000 | Troiano | 74/512 |
| 6,106,033 | A | * | 8/2000 | Ruckert | 292/216 |
| 6,109,670 | A | * | 8/2000 | Tomaszewski et al. | 292/216 |
| 6,149,210 | A | * | 11/2000 | Hunt et al. | 292/216 |
| 6,361,091 | B1 | * | 3/2002 | Weschler | 292/225 |

* cited by examiner

*Primary Examiner*—J. J. Swann
*Assistant Examiner*—Matthew E. Rodgers
(74) *Attorney, Agent, or Firm*—Brooks & Kushman P.C.

(57) ABSTRACT

A secondary latch (38) for a vehicle hood (34) includes a secondary latch member (90) that is mounted on the vehicle body (22) by a pin and slot mounting connection (98) for pivotal movement between latched and unlatched positions with respect to an associated striker (40) on the hood and for translational movement between a lower retracted position and an upper extended position.

5 Claims, 5 Drawing Sheets

Fig. 1
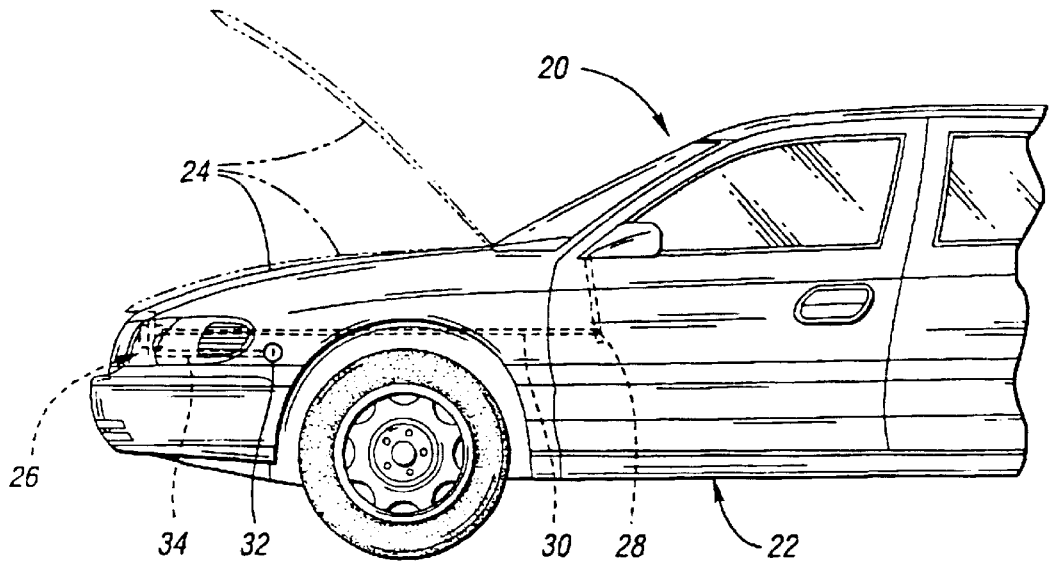
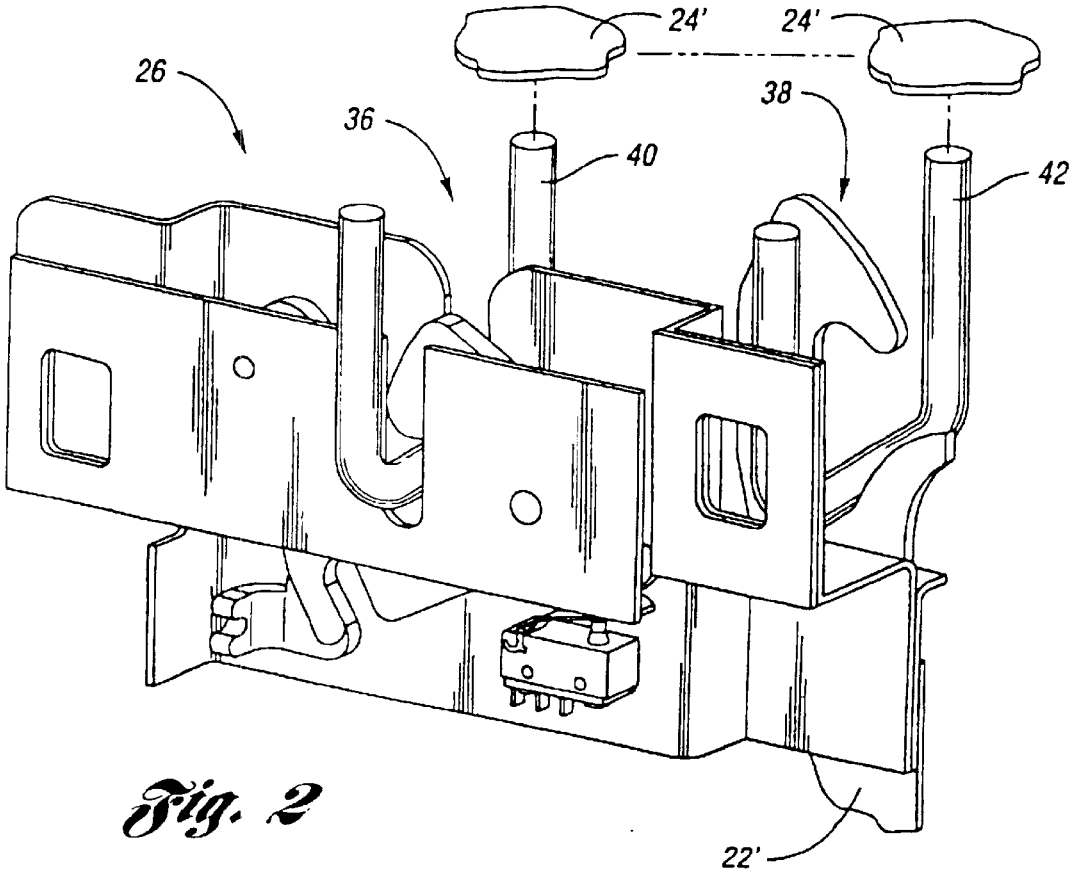
Fig. 2

24'
40
92
102
90
26'
44
38
104
106
94
22'
98 110 108 96 100 101

24'
40
92
26'
44
102
90
38
104
106
94
22'
98 110 108 96 100 101

LATCH ASSEMBLY FOR VEHICLE HOOD

BACKGROUND OF THE INVENTION

1. Field of the Invention

This invention relates to a latch assembly having a secondary latch for securing a vehicle hood in a partially open position after release of the hood by a primary latch.

2. Background Art

Vehicle body hoods are conventionally mounted by hinge assemblies on a vehicle body for movement between closed and open positions. A primary latch is conventionally utilized to secure the hood in the closed position and is releasable to release the hood for movement from the closed position to the open position. Normally the release is provided by an operator within the vehicle occupant compartment either through a cable connection or through an electric connection to a solenoid of the latch. As such, individuals such as valets who have access to the passenger compartment also have access to the engine compartment under the hood even though they do not have any authority or reason for such engine compartment access.

Also, a vehicle hood latch assembly also conventionally includes a secondary latch for holding the hood in a partially open position after it is initially released by the primary latch. Such secondary latches normally include a latch member that extends upwardly and, in order to have sufficient manual access to permit release of the secondary latch, a hood inner panel often needs to have a hole that receives the upper end of the secondary latch member in the fully closed position.

Prior art references noted during an investigation conducted in connection with the invention include U.S. Pat. Nos. 2,246,787 Dall; U.S. Pat. No. 2,246,794 Dall; U.S. Pat. No. 2,256,465 Brubaker; U.S. Pat. No. 3,796,075 Grogan; U.S. Pat. No. 3,905,624 Fujita; U.S. Pat. No. 4,456,289 Badiali; U.S. Pat. No. 4,671,548 Häberle et al.; U.S. Pat. No. 4,702,094 Peterson; U.S. Pat. No. 4,752,092 Faust; U.S. Pat. No. 4,836,591 Faust; U.S. Pat. No. 4,875,350 Faust; U.S. Pat. No. 4,951,979 Escaravage; U.S. Pat. No. 4,961,601 Lindholm et al.; U.S. Pat. No. 5,048,877 Rogers, Jr. et al.; U.S. Pat. No. 5,247,817 Körner et al.; U.S. Pat. No. 5,725,260 Eikmeier et al.; U.S. Pat. No. 5,793,122 Dingwall et al.; U.S. Pat. No. 5,833,024 Kancko; and U.S. Pat. No. 6,014,876 Taylor.

SUMMARY OF THE INVENTION

An object of the present invention is to provide an improved latch assembly for a vehicle hood.

In carrying out the above object, the latch assembly of the invention functions with a vehicle hood mounted on a vehicle body for movement between a fully open position and a fully closed position. The latch assembly includes a primary latch having a latching catch movable between: a latching position to secure the vehicle hood in the closed position, and an unlatched position that permits movement of the hood from the closed position toward the open position. The latch assembly also includes a secondary latch member having an upper hook end for engaging a striker mounted on the hood to hold the hood in a partially open position when the latching catch of the primary latch is in the unlatched position. The secondary latch member has an engagement surface located below the upper hook end. A lower end of the secondary latch member is located below the engagement surface. A pin and slot mounting connection of the second latch mounts the lower end of the secondary latch member on the vehicle body for pivotal movement between latched and unlatched positions with respect to the striker and for translational movement between a lower retraced position and an upper extended position. The secondary latch member is moved to the lower retracted position by closing movement of the hood as the striker engages the engagement surface of the secondary latch member, and the secondary latch member is moved to the upper extended position by opening movement of the hood.

The secondary latch also includes a spring for biasing the secondary latch member to the latched position and for biasing the secondary latch member upwardly to its upper extended position.

The upper hook end of the secondary latch member includes a first cam surface that pivots the secondary latch member against the bias of the spring from the latched position to the unlatched position when the hood is moved from the fully open position toward the fully closed position. The secondary latch member also has a cam arm including a second cam surface that extends from the engagement surface and is engaged by the striker as the vehicle hood is moved toward the fully closed position to ensure that the secondary latch member moves to the latched position.

BRIEF DESCRIPTION OF THE DRAWINGS

FIG. 1 is a partial side elevational view of a vehicle body including a hood that is mounted on the body for movement between closed and open positions and secured in fully closed and partially closed positions by a latch assembly that embodies the present invention.

FIG. 2 is a perspective view of one embodiment of the latch assembly which includes a primary latch and a secondary latch.

DETAILED DESCRIPTION OF THE PREFERRED EMBODIMENTS

Figure 3:
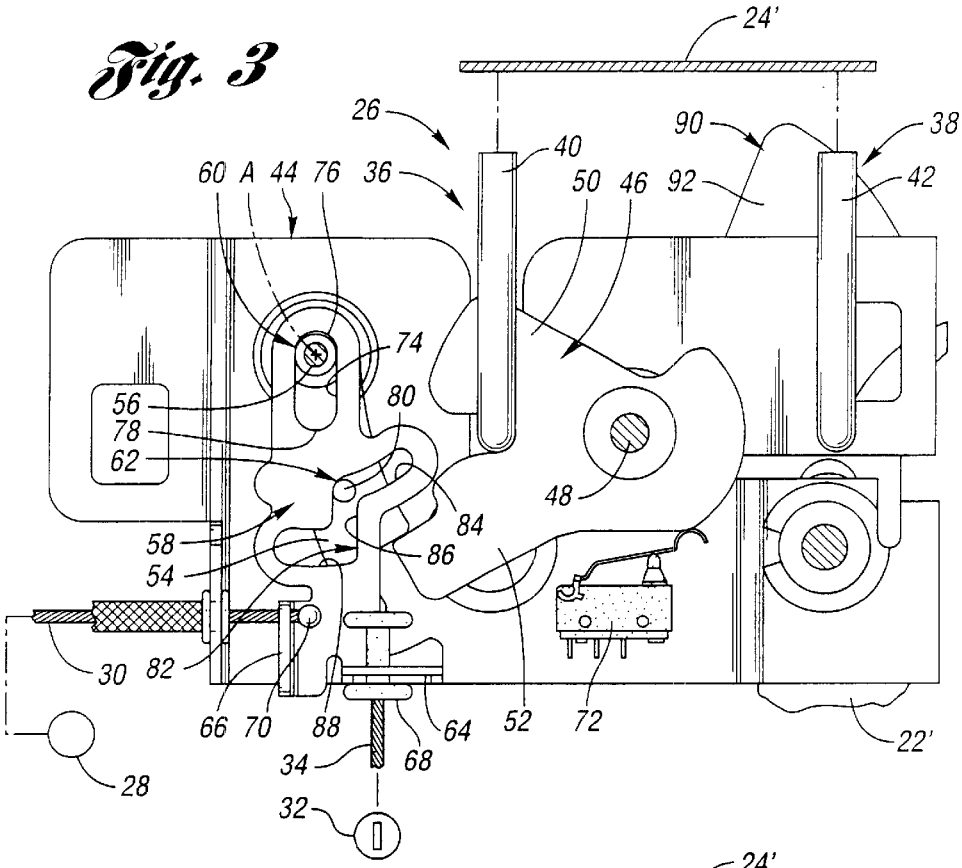
FIG. 3 is a view of the latch assembly and illustrates the primary latch with a release lever thereof that is positioned to freewheel when actuated by a connector that is actuated from within the vehicle occupant compartment.

With reference to FIG. 1 of the drawings, a vehicle generally indicated by 20 includes a vehicle body 22 having an engine compartment hood 24 that is shown in a fully closed position by solid line representation. The vehicle hood 24 functions in a conventional manner as a closure member and is mounted by unshown hinges for movement between the solid line indicated fully closed position, the phantom line indicated partially open position, and the phantom line indicated fully open position. The hood 24 thus controls access to an associated vehicle engine compartment below the hood. A latch assembly 26 that embodies the present invention is operable to secure the hood 24 in its fully closed position and to release the hood for movement to its partially open position and to then release the hood by manual actuation for movement to its fully open position as is hereinafter more fully described. A manually operated actuator 28 is connected by a release cable 30 to the latch assembly 26 to release the hood 24 for movement from the fully closed position to the partially open position. It should be appreciated that this release can also be provided by a solenoid operated actuator that is controlled by a switch within the vehicle occupant compartment. A key operated actuator 32 is connected by a control cable or rod connection 34 to the latch assembly 26 and is operable to prevent the release of the hood 24 by the first actuator 28 as is hereinafter more fully described. As shown, the key operated actuator 32 is on the vehicle front fender; however it can also be located at other external locations on the vehicle or within the vehicle occupant component.

With reference to FIG. 2, the latch assembly 26 includes a primary latch 36 and a secondary latch 38. The primary latch 36 functions to secure the vehicle hood in its fully closed position as described above in connection with FIG. 1 and is actuated to release the hood for movement to its partially open position where it is held by the secondary latch 38 until manual actuation releases the secondary latch to permit movement of the hood to its fully open position. The operation of the secondary latch thus prevent inadvertent opening of the hood during vehicle travel.

Figure 7:
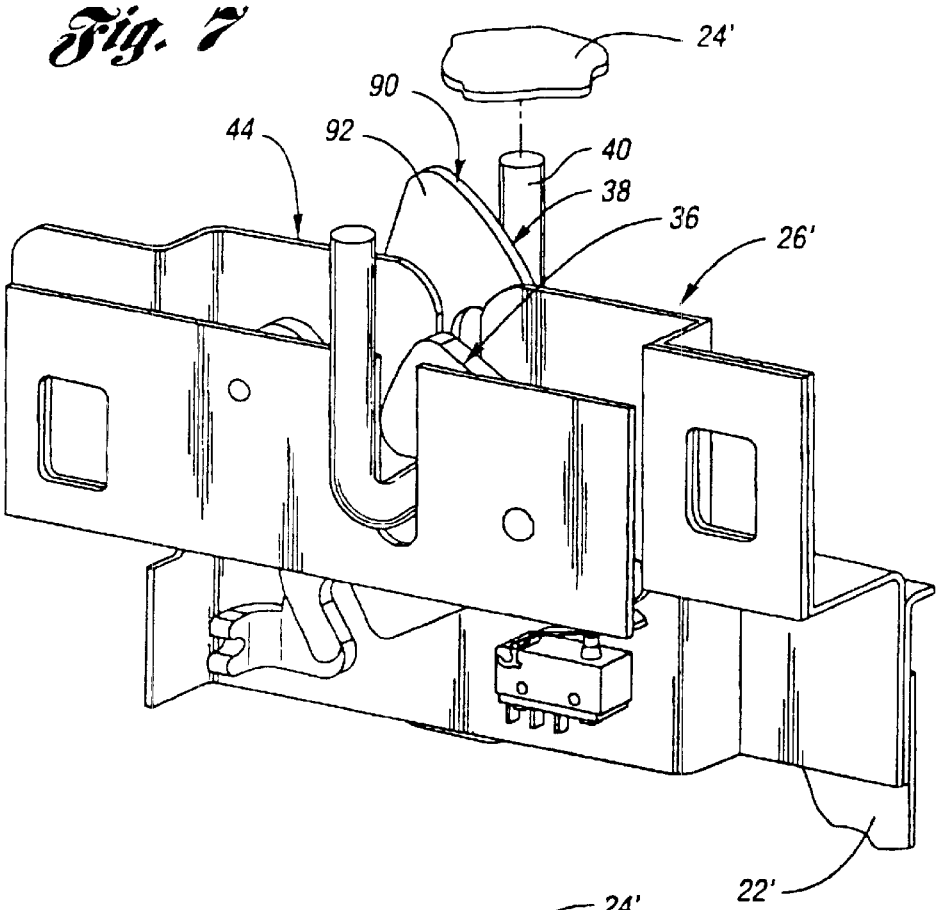
FIG. 7 is a perspective view similar to FIG. 2 but illustrating another embodiment wherein the primary latch and the secondary latch operate on the same striker instead of different strikers as shown by the embodiment of FIG. 2.

The primary latch 36 will now be described with reference to FIGS. 1 and 2. It should be appreciated that this latch 36 has particular utility for use with a vehicle hood as illustrated but could also have use with other vehicle closure members such as, for example, vehicle rear deck lids. Furthermore, while the latch 36 is illustrated as being mounted on a vehicle body closure member 22' to secure a striker 40 mounted on a vehicle hood member 24', the respective positions of these components could be reversed. Furthermore, while the secondary latch 38 is illustrated as being operable to secure a second striker 42 that is spaced from the striker 40, another embodiment of the latch assembly 26' illustrated in FIG. 7 has both the primary latch 26 and the secondary latch 38 operable with the same striker 40.

With reference to FIG. 3, the primary latch 36 of the latch assembly 26 includes a housing 44 that is mounted on the vehicle body member 22' in a conventional manner. A latching catch 46 of the latch 36 is mounted on the housing 44 by a pin connection 48 for pivotal movement between the latching position shown and an unlatched position partially shown by phantom line representation in FIG. 6. The latching catch 46 is spring biased by a spring on the unshown side and has a latching arm 50 that secures the striker 40 in the latching position. A control arm 52 of the latching catch 46 is engaged by the striker 40 during closing movement of the vehicle hood to move the latching catch from the unlatched position to the latching position against the bias of the latching catch spring. Upon release of the latching catch 46, the striker 40 is released as is hereinafter more fully described to permit opening movement of the vehicle hood under the control of the secondary latch 38 as is also hereinafter described.

Figure 6:
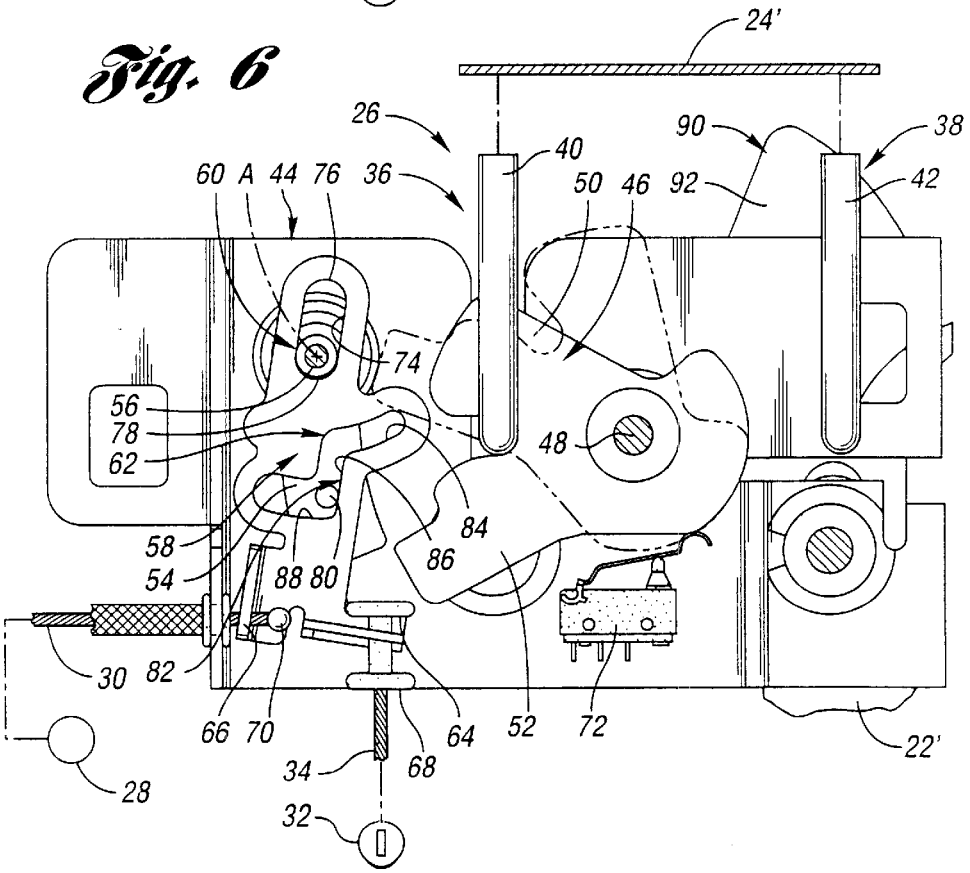
FIG. 6 is a view similar to FIG. 5 showing the latch after the release lever has been pivoted to permit movement of a latching catch from the solid line indicated latched position to a partial phantom line indicated unlatched position.

With continuing reference to FIG. 3, the primary latch 36 also includes a latching pawl 54 that is mounted on the housing 44 by a pin 56 for movement between the latching position shown and an unlatched position shown in FIG. 6. In the latching position shown in FIG. 3, the latching pawl 54 engages the control arm 52 of the latching catch 48 to prevent clockwise rotation thereof such that the latching arm 50 secures the striker 40 against upward movement and thereby holds the vehicle hood in its fully closed position. Movement of the latching pawl 54 to the unlatched position of FIG. 6 by clockwise rotation as is hereinafter more fully described releases the control arm 52 of the latching catch 46 to permit its movement to the phantom line indicated unlatched position where the striker 40 is free to move upward for opening of the hood subject only to the operation of the secondary latch 38.

With reference back to FIG. 3, the primary latch 36 also includes a release lever 58 that is illustrated extending generally vertically. A pin and slot mounting connection 60 mounts the release lever 58 on the housing 44 for pivotal and translational movement. A pin and slot control connection 62 extends between the latching pawl 54 and the release lever 58. A common unshown spring biases both the latching pawl 54 and the release lever 58 in a counterclockwise direction.

Figure 4:
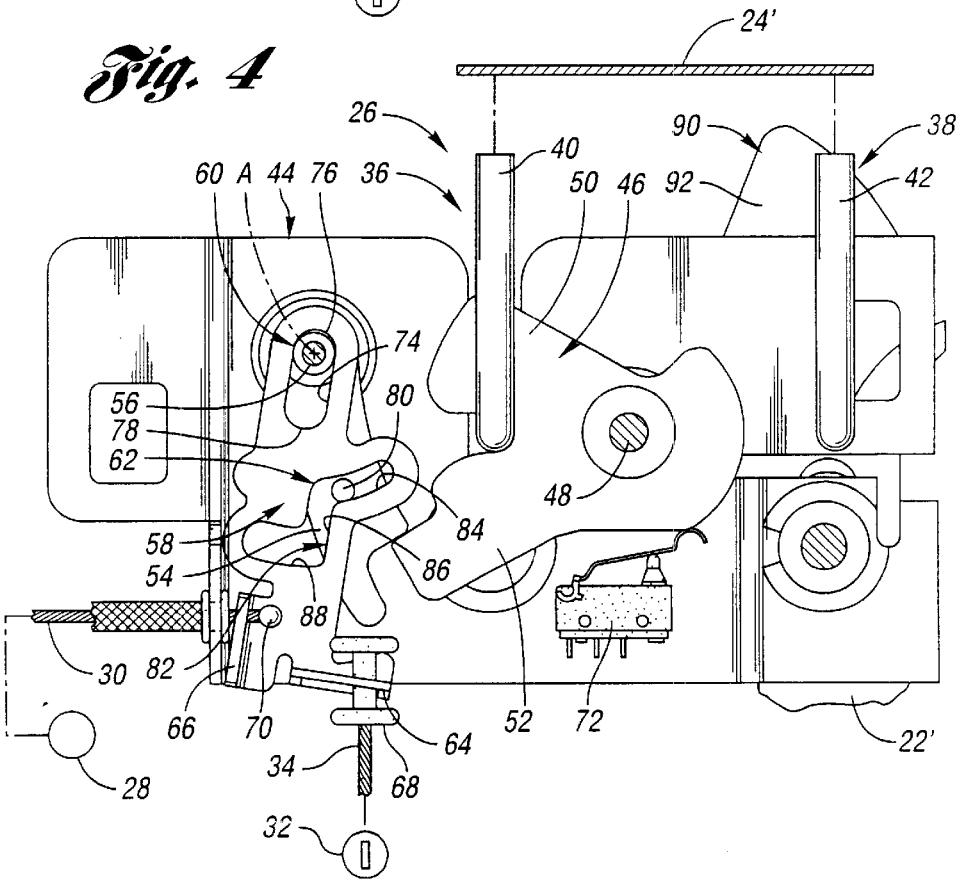
FIG. 4 is a view similar to FIG. 3 showing the freewheeling operation of the latch when the connector is actuated from within the vehicle occupant compartment.
Figure 5:
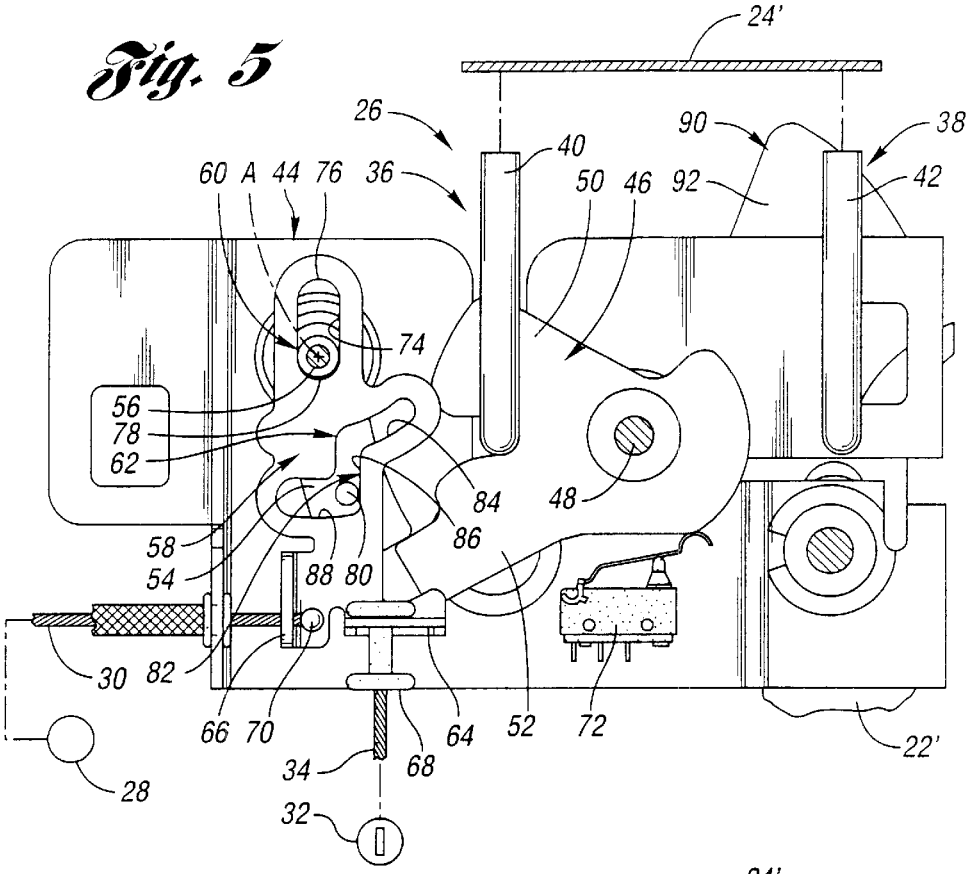
FIG. 5 is a view similar to FIG. 3 but showing the release lever of the latch translated to an operating position by actuation of another connector such that actuation of connector within the vehicle occupant compartment can provide release of the latch.

The release lever 58 includes a first connector 64 for use in moving the release lever for translational movement as permitted by the pin and slot mounting connection 60 for movement between a freewheeling position as illustrated in FIGS. 3 and 4 and an operating position as shown in FIGS. 5 and 6. The release lever 58 also includes a second connector 66 for use in pivotally moving the release lever by the actuator 28.

The first connector 64 is operated by a spool end fitting 58 of the connection 34 that is operated by the key operated actuator 32. Furthermore, the second connector 66 is operated by a ball or cylindrical end fitting 70 of the cable 30 controlled by the actuator 28 within the vehicle occupant compartment.

When the first connector 64 through operation of its connection 34 positions the release lever 58 in the freewheeling position of FIG. 3, pivotal movement of the release lever by the passenger compartment actuator 28 through the cable 30 provides freewheeling of the release lever with respect to the latching pawl 54 such that the latching catch 46 remains in its latching position. As such, access to the passenger occupant compartment does not permit unauthorized access to the engine compartment. When the key operated actuator 32 moves the first connector 36 to move the release lever 58 by translational movement to the operating position of FIG. 5, operation of the passenger compartment actuator 28 through the cable 30 and through the control connection 62 moves the latching catch 46 from its latching position to its unlatched position shown in FIG. 6 to thereby release the latching catch 46 for movement from its solid line indicated latching position to its phantom line indicated unlatched position in order to release the striker 40 and permit the initial movement of the vehicle hood from its fully closed position toward the open position.

As shown in FIGS. 3–6, the latch 36 includes a sensor 72 for sensing whether the latching catch 46 is in its latching position or its unlatched position and thereby provides a suitable signal to provide an indication of the condition of the latch in order to permit this signal to be read by vehicle instrumentation to provide a visual indication to the driver.

With continuing reference to FIGS. 3–5, the pin and slot mounting connection 60 includes the mounting pin 56 that also pivotally mounts the latch pawl 54 and has a mounting axis A about which the release lever 58 is pivotally moved by the second connector 66. The pin and slot mounting connection 60 also includes a mounting slot 74 for receiving the mounting pin 56. This mounting slot 74 has a first end 76 where the mounting pin 56 is located when the release lever 58 is in its freewheeling position shown in FIGS. 3 and 4. The mounting slot 74 has a second end 78 where the mounting pin 56 is located when the release lever 58 is in its operating position as shown in FIGS. 5 and 6. As previously mentioned, the latching pawl 54 is pivotally mounted about the mounting axis A of the mounting pin 56.

As shown in each of FIGS. 3–6, the pin and slot control connection 62 of the latch 36 has a control pin 80 on the latching pawl 54 and a control slot 82 in the release lever 58 for receiving the control pin. The control slot 82 has a first arcuate slot portion 84 that extends about the first end 76 of the mounting slot 74 such that the control pin 80 moves within this first arcuate slot portion when the release lever 58 is pivoted in the freewheeling position as illustrated in FIGS. 3 and 4. The control slot 82 also includes a second straight portion 86 that extends from the first arcuate portion 84, and the control pin 80 is moved within this second straight slot portion 86 when the first connector 64 is operated by the key actuated connection 34 to provide the translational movement of the release lever 58 between the freewheeling position of FIG. 3 and the operating position of FIG. 5. The control slot 82 also has a third arcuate portion 88 that receives the control pin 80 to allow the latching pawl 54 to pivot clockwise without any concomitant pivoting of the release lever 58 when the latching pawl is engaged by the control arm 52 of the latching catch 46 during hood closing.

Figure 8:
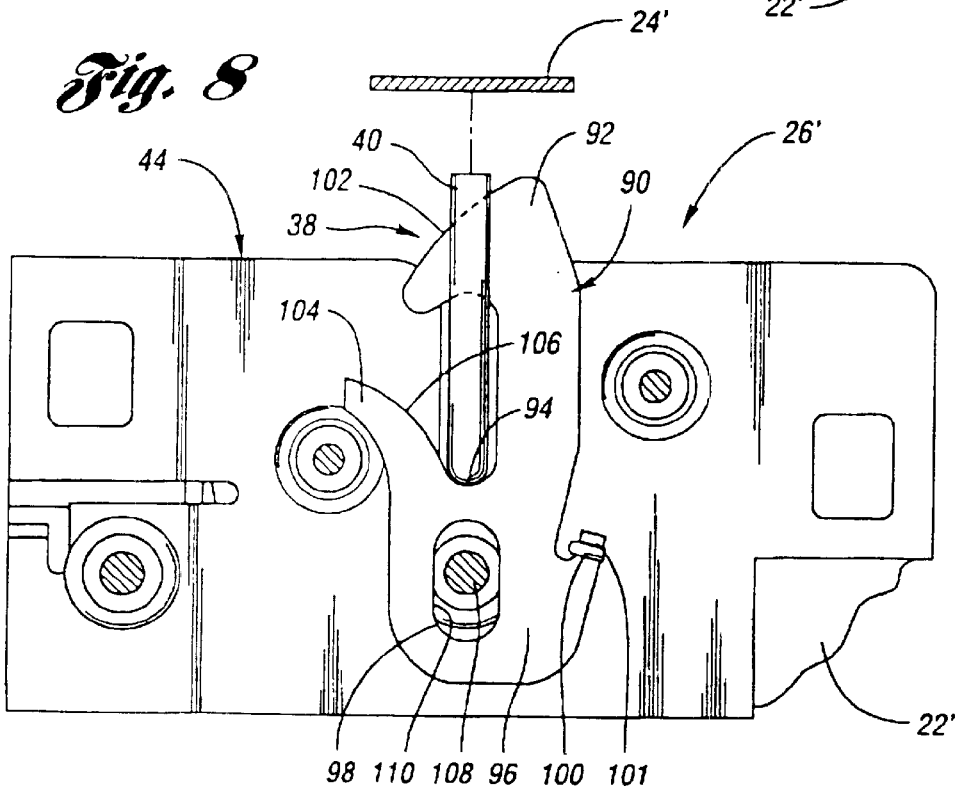
FIG. 8 is a view that illustrates the secondary latch with a secondary latch member thereof in a retracted position corresponding to a fully closed position of the associated vehicle hood.

With reference to FIGS. 7–10, the secondary latch 38 of the latch assembly 26 will be described in connection with the embodiment where it operates with the same striker 40 utilized with the primary latch. However, it should be appreciated that this description is also applicable to the embodiment of FIGS. 1–6 where the secondary latch operates in association with a second striker. The secondary latch 38 as shown in FIG. 8 includes a secondary latch member 90 having an upper hook end 92 for engaging the striker 40 mounted on the hood member 24' to hold the hood in the partially open position after release of the primary latch as previously described. The secondary latch member 90 also has an engagement surface 94 located below the upper hook end 92. A lower end 96 of the secondary latch member 90 is located below the engagement surface 94. A pin and slot mounting connection 98 of the secondary latch mounts the lower end 96 of the latch member 90 on the latch housing 44 so as to thus also be mounted on the vehicle body by the securement of the housing to the vehicle body member 22'. The pin and slot mounting connection 98 mounts the latch member 90 with respect to the striker 40 for pivotal movement between a latched position best illustrated in FIG. 9 and an unlatched position illustrated in FIG. 10. The pin and slot mounting connection 98 also permits translational movement of the secondary latch member 90 for movement between the lower retracted position shown in FIG. 8 and the upper extended position shown in FIG. 9. This translational movement allows the secondary latch member 92, while holding the hood in the partially open position, to provide sufficient manual access under the hood for its manual operation for movement to the unlatched position without extending so far upwardly in the closed position so as to require any hole in the hood inner member for accommodating the upper hook end 92.

Figure 9:
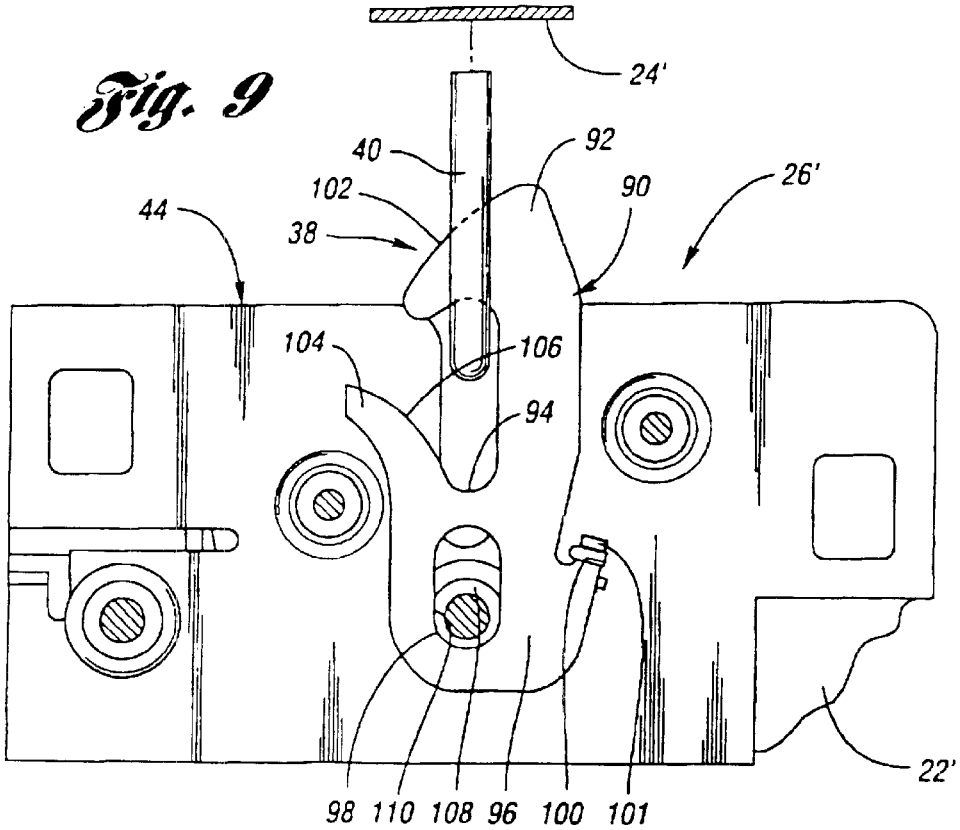
FIG. 9 is a view similar to FIG. 8 but showing the secondary latch after the hood has been moved to the partially open position where the secondary latch member secures the hood from further opening.
Figure 10:
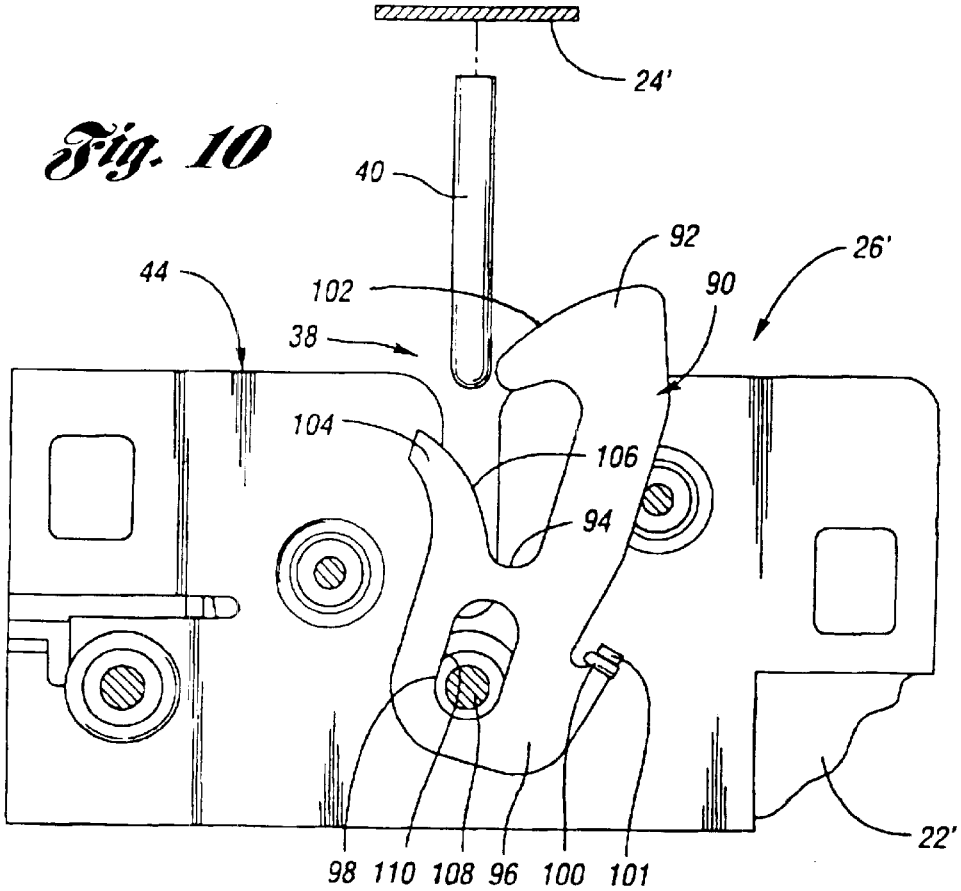
FIG. 10 is a view similar to FIG. 9 but showing the secondary latch member moved to an unlatched position to release the hood mounted striker for movement of the hood to its fully open position.

A partially illustrated spring 100 extends from the pin and slot mounting connection 98 and engages a flange 101 of the secondary latch member 90 to bias the secondary latch member to its latched position as illustrated in FIGS. 8 and 9. The spring 100 also biases the secondary latch member 90 upwardly to its upper extended position shown in FIG. 9. The secondary latch member 90 includes a first cam surface 102 that is engaged by the downwardly moving striker 40 during hood closing to pivot the secondary latch member against the bias of spring 100 from the latched position to the unlatched position as the hood is moved toward the fully closed position. The secondary latch member 90 also has a cam arm 104 including a second cam surface 106 that extends from the engagement surface 94 and is engaged by the striker 40 as the vehicle hood is moved toward the fully closed position to ensure that the secondary latch member 90 moves to the latched position even if there is spring failure or binding of the mounting connection that is greater than the spring force.

Upon release of the primary latch as previously described, the secondary latch member 90 moves upwardly by the bias of spring 100 from the position of FIG. 8 to the position of FIG. 9 as the striker 40 moves upwardly until it is stopped and held by the upper hook end 92 of the secondary latch member. The secondary latch member 90 can then be manually moved to its unlatched position either by manual manipulation thereof directly or through another lever operator that moves the secondary latch member in order to permit full opening of the hood.

During closing movement of the hood, the striker 40 initially engages the upper cam surface 102 of the secondary latch member 90 to pivot the secondary latch member to its unlatched position until the striker moves below the upper hook end 92 whereupon the spring force and/or the caming surface 106 of the cam arm 104 move the secondary latch member back to the latched position. Continued downward movement of the hood causes the striker 40 to engage the engagement surface 94 of the secondary latch member 90 and to move it downwardly against the upward spring bias to its retracted position shown in FIG. 8 as permitted by the pin and slot mounting connection 98. This pin and slot mounting connection 98 includes a pin 108 mounted on the housing 44 and an elongated slot 110 in the lower end 96 of the secondary latch member 90. The slot 110 receives the pin 108 and permits the vertical movement of the secondary latch member 90 as described above during the latching and unlatching operations of the secondary latch 38.

While the best modes for carrying out the invention have been described in detail, other embodiments for practicing the invention will be apparent to those skilled in the art as defined by the following claims.

What is claimed is:

1. A latch assembly for a vehicle hood mounted on a vehicle body for movement between a fully open position and a fully closed position, the latch assembly comprising:

a primary latch including a latching catch movable between: a latching position to secure the vehicle hood in the closed position, and an unlatched position that permits movement of the hood from the closed position toward the open position;

a secondary latch including a secondary latch member having an upper hook end for engaging a striker mounted on the hood to hold the hood in a partially open position when the latching catch of the primary latch is in the unlatched position, the secondary latch member having an engagement surface located below the upper hook end, and the secondary latch member having a lower end located below the engagement surface; and a pin and slot mounting connection for mounting the lower end of the secondary latch member on the vehicle body for pivotal movement between latched and unlatched positions with respect to the striker and for translational movement between a lower retracted position and an upper extended position, the secondary latch member being moved to the lower retracted position by closing movement of the hood as the striker engages the engagement surface of the secondary latch member, and the secondary latch member being moved to the upper extended position by opening movement of the hood as the striker engages the upper hook end of the secondary latch member.

2. A vehicle hood latch assembly as in claim 1 further including a spring for biasing the secondary latch member to the latched position and for biasing the secondary latch member upwardly to its upper extended position.

3. A vehicle hood latch assembly as in claim 2 wherein the upper hook end of the secondary latch member includes a cam surface that pivots the secondary latch member against the bias of the spring from the latched position to the unlatched position when the vehicle hood is moved from the fully open position toward the fully closed position.

4. A vehicle hood latch assembly as in claim 3 wherein the secondary latch member having a cam arm including a second cam surface that extends from the engagement surface and is engaged by the striker as the vehicle hood is moved toward the fully closed position to ensure that the secondary latch member moves to the latched position.

5. A latch assembly for a vehicle hood mounted on a vehicle body for movement between a fully open position and a fully closed position, the latch assembly comprising:

a primary latch including a latching catch movable between: a latching position to secure the vehicle hood in the closed position, and an unlatched position that permits movement of the hood from the closed position toward the open position;

a secondary latch including a secondary latch member having an upper hook end for engaging a striker mounted on the hood to hold the hood in a partially open position when the latching catch of the primary latch is in the unlatched position, the secondary latch member having an engagement surface located below the upper hook end, and the secondary latch member having a lower end located below the engagement surface;

a pin and slot mounting connection for mounting the lower end of the secondary latch member on the vehicle body for pivotal movement between latched and unlatched positions with respect to the striker and for translational movement between a lower retracted position and an upper extended position, the secondary latch member being moved to the lower retracted position by closing movement of the hood as the striker engages the engagement surface of the secondary latch member, and the secondary latch member being moved to the upper extended position by opening movement of the hood;

a spring for biasing the secondary latch member to the latched position and for biasing the secondary latch member upwardly to its upper extended position;

the upper hook end of the secondary latch member including a cam surface that pivots the secondary latch member against the bias of the spring from the latched position to the unlatched position when the vehicle hood in moved from the fully open position toward the fully closed position; and the secondary latch member having a cam arm including a second cam surface that extends from the engagement surface and is engaged by the striker as the vehicle hood is moved toward the fully closed position to ensure that the secondary latch member moves to the latched position.

* * * * *